US005144816A

United States Patent [19]

Chase

[11] Patent Number: 5,144,816

[45] Date of Patent: Sep. 8, 1992

[54] OUTSIDE AIR CIRCULATION SYSTEM FOR WALK-IN COOLERS

[76] Inventor: Rudolph L. Chase, Box 10, Craftsbury, Vt. 05826

[21] Appl. No.: 634,383

[22] Filed: Dec. 27, 1990

[51] Int. Cl.[5] ..... F25D 17/04; F25D 17/06

[52] U.S. Cl. ..... 62/408; 62/409; 62/411; 62/412; 62/180

[58] Field of Search ..... 62/408, 409, 411, 412, 62/180

[56] References Cited

U.S. PATENT DOCUMENTS

| | | | |
|---|---|---|---|
| 4,023,947 | 5/1977 | Ferry | 62/409 X |
| 4,147,038 | 4/1979 | Hoebing et al. | 62/409 X |
| 4,175,401 | 11/1979 | McManus | 62/412 X |
| 4,178,770 | 12/1979 | Fox | 62/412 X |
| 4,245,481 | 1/1981 | McDermott | 62/411 X |
| 4,358,934 | 11/1982 | Van Kirk | 62/409 X |
| 4,478,138 | 10/1984 | Venditti et al. | 62/412 X |

*Primary Examiner*—Henry A. Bennet
*Assistant Examiner*—Christopher Kilner
*Attorney, Agent, or Firm*—Fleit, Jacobson, Cohn, Price, Holman & Stern

[57] ABSTRACT

The air circulation system includes a fan unit for discharging filtered ambient air below a predetermined temperature into a walk-in cooler through a damper and exhausting warm air out of the walk-in cooler through a damper by using a discharge fan with the supply fan and discharge fan being controlled by an accustat. The fans, inlet filter and damper are incorporated into a generally rectangular housing that can be easily installed in a wall of a walk-in cooler or other similar enclosure with the air supply being ducted if desired.

3 Claims, 2 Drawing Sheets

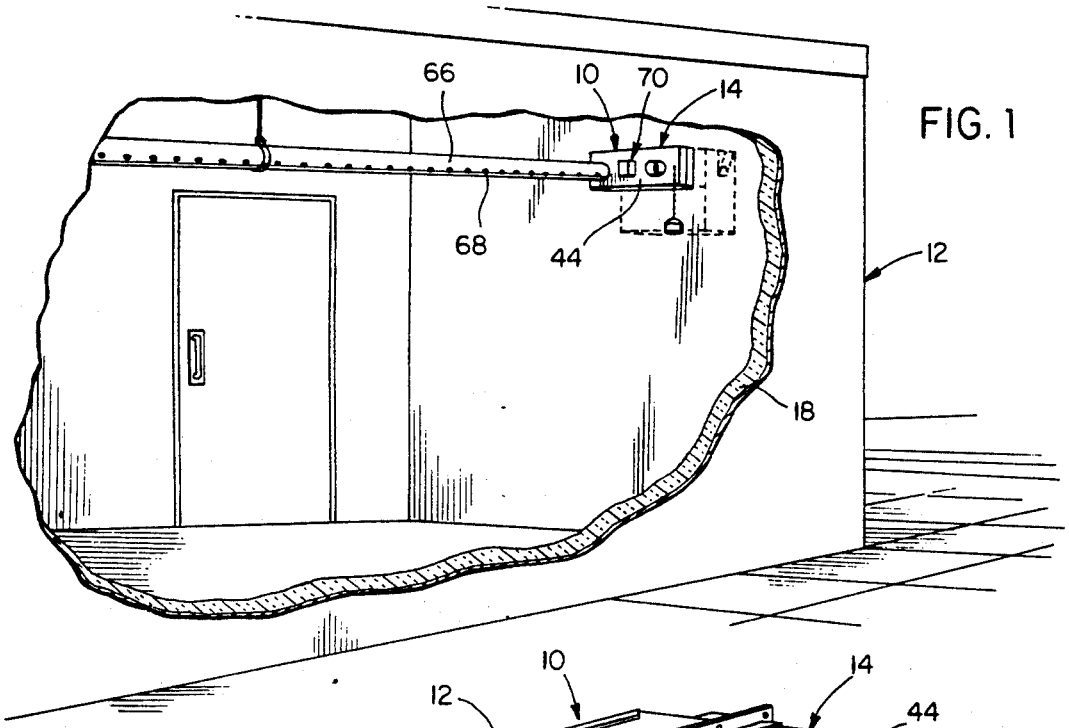
FIG. 1
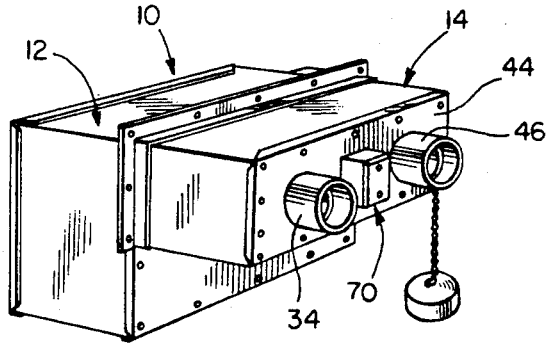
FIG. 5
FIG. 3
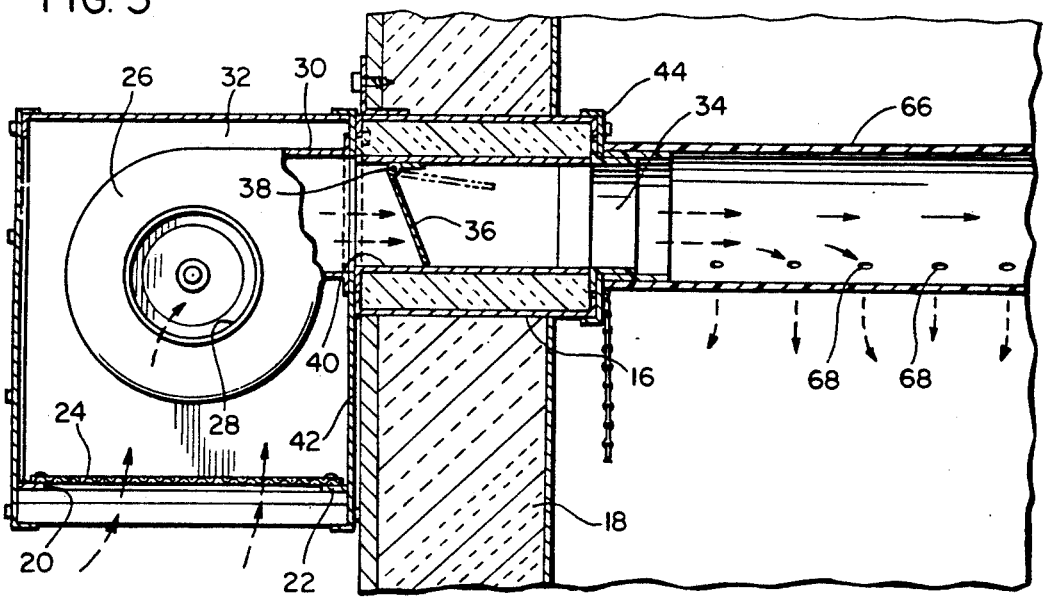

OUTSIDE AIR CIRCULATION SYSTEM FOR WALK-IN COOLERS

BACKGROUND OF THE INVENTION

1. Field of the Invention

An air circulation system by which relatively cold ambient air can be used to cool a walk-in cooler in lieu of using a refrigeration system. The air circulation system includes a fan unit for discharging filtered ambient air below a predetermined temperature into a walk-in cooler through a damper and exhausting warm air out of the walk-in cooler through a damper by using a discharge fan with the supply fan and discharge fan being controlled by an accustat. The fans, inlet filter and damper are incorporated into a generally rectangular housing that can be easily installed in a wall of a walk-in cooler or other similar enclosure with the air supply being ducted if desired.

2. Description of the Prior Art

Walk-in coolers used for maintaining various items, especially bulky items within certain temperature parameters are well known with various types of refrigeration systems being provided for maintaining the conditions within the walk-in cooler. However, the prior art does not include the use of relatively cold outside air to maintain a desired low temperature in the walk-in cooler in lieu of the refrigeration system which normally maintains the temperature in the walk-in cooler. The present invention provides a compact and relatively simple air circulation system for this purpose.

SUMMARY OF INVENTION

An object of the present invention is to provide an air circulation system for supplying the cold outside air to a walk-in cooler and exhausting warm air from the walk-in cooler to maintain a desired temperature condition within the walk-in cooler without using the existing refrigeration system for the walk-in cooler thus resulting in reduced operating cost and reduced maintenance of the existing refrigeration system.

Another object of the invention is to provide an air circulation system in accordance with the preceding object which is incorporated into a housing which can be quickly and easily installed in the wall of a walk-in cooler or similar insulated enclosure with operation of the air circulation system being fully automatic and responding to an accustat or similar control device.

A further object of the invention is to provide an air circulation system in accordance with the preceding objects in which the housing includes a supply fan for supplying filtered cold outside air to the walk-in cooler through a gravity operated damper which will automatically open when air is discharged by the supply fan and a discharge fan for discharging air from the walk-in cooler through a gravity operated damper which will automatically open when the warm air discharge fan is activated.

Still another object of the invention is to provide an air circulating system for maintaining the temperature in a walk-in cooler by using outside winter air in lieu of an existing refrigeration system in which the cold air may be ducted to desired discharge areas if desired with the system being easily installed, automatically controlled and effective for reducing the operating and maintenance cost of a walk-in cooler.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the air circulation system of the present invention incorporated into a wall of a walk-in cooler.

FIG. 3 is a sectional view taken along section line 3—3 on FIG. 2 illustrating further structural details of the supply side of the housing.

FIG. 5 is a perspective view of the housing which incorporates the components of the air circulating system therein.

DESCRIPTION OF THE PREFERRED EMBODIMENT

Figure 2:
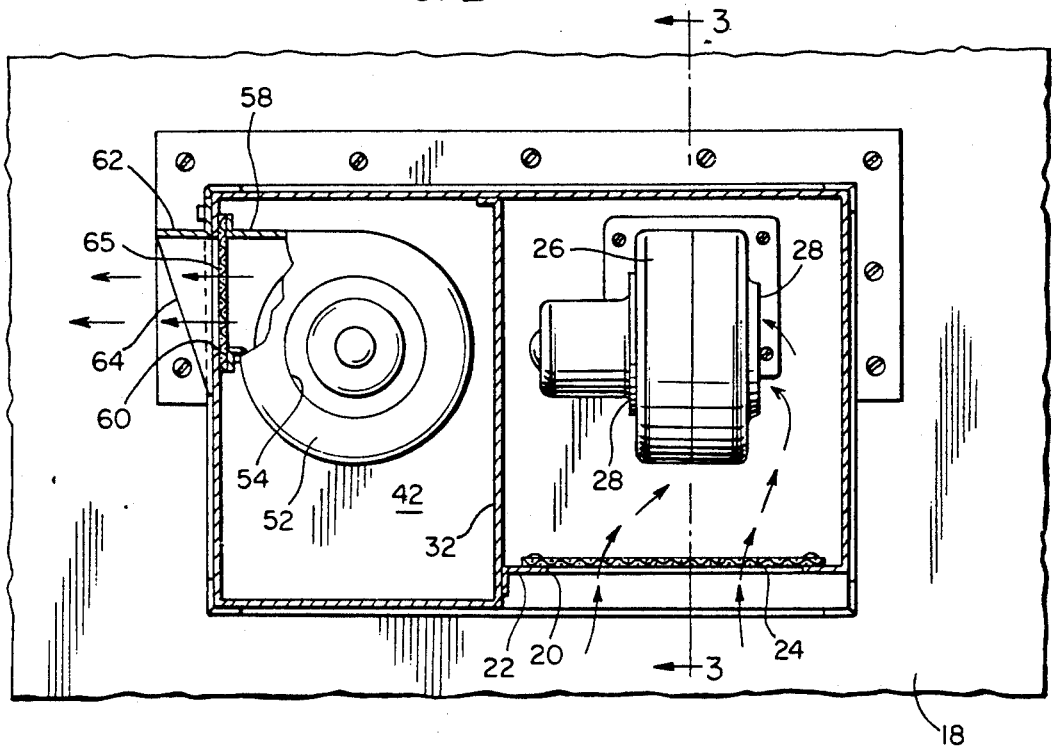
FIG. 2 is a transverse sectional view illustrating structural details of the invention.
Figure 4:
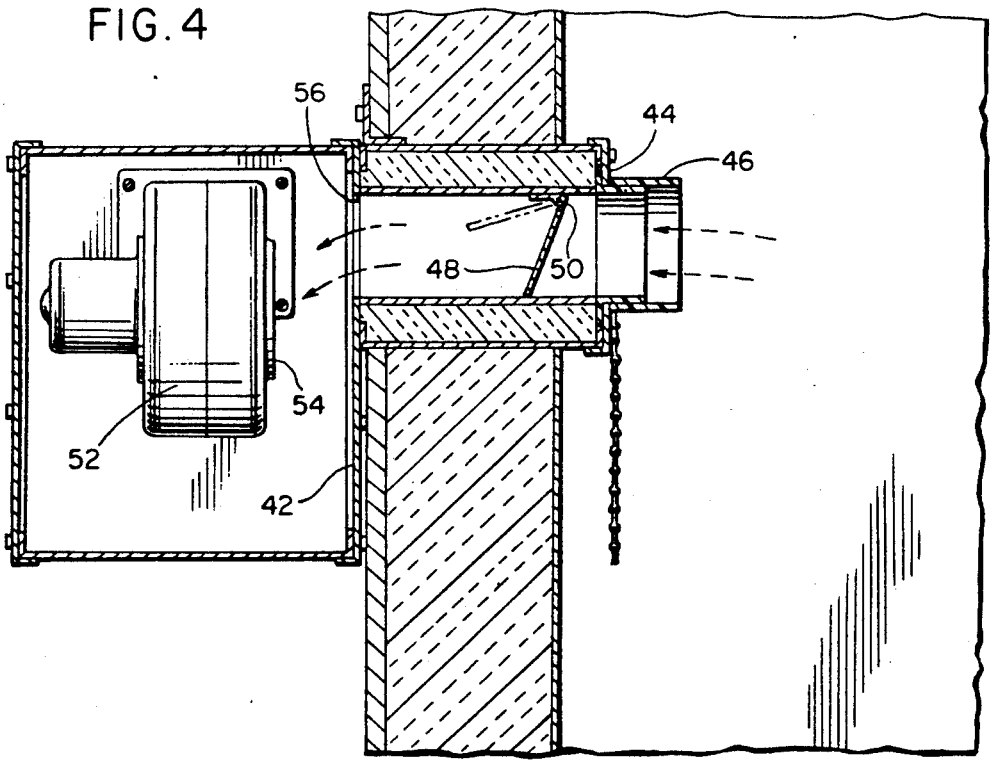
FIG. 4 is a sectional view illustrating additional details of construction of the discharge side of the housing.

Referring now specifically to the drawings, the air circulation system of the present invention is generally designated by reference numeral 10 and, as illustrated in FIG. 1, is associated with a conventional walk-in cooler generally designated by reference numeral 12 which utilizes a conventional and well known refrigeration system and controls for maintaining the temperature and humidity conditions within the walk-in cooler 12 within certain desired parameters depending upon the items or products oriented in the walk-in cooler. The air circulation system 10 includes a generally rectangular housing 12 which includes a lateral extension 14 extending through an opening 16 in an insulated wall 18 of the walk-in cooler 12 with suitable sealing material utilized to provide an air and waterproof seal between the housing extension 14 and the opening 16 in the wall 18 of the walk-in cooler 12.

As illustrated, the rectangular housing 12 positioned externally of the wall 18 includes an air inlet 20 in the bottom wall 22 with a filter 24 being provided in the opening 20 to filter incoming air. An air supply fan is provided in the housing which may be preferably a squirrel cage fan driven by a suitable electric motor and mounted in an adequate manner from the interior of the housing so that the central inlet 28 of the fan 26 will intake air through the air inlet 20 and filter 24 and discharge air through a tangential outlet 30. The housing 12 and the extension 14 includes a divider 32 which separates the housing and extension into a supply side and discharge side. The supply side of the extension 14 includes a tubular discharge member 34 projecting laterally therefrom into the interior of the walk-in cooler and interiorly of the extension 14, there is a gravity operated damper or flap valve 36 hingedly supported along its top edge by a hinge structure 38 which forms a closure for an opening 40 in a partition wall 42 to which the tangential discharge 30 of the supply fan 26 is connected. Thus, when the supply fan 26 is actuated, the air discharged from the fan 26 will cause the damper or flap valve 36 to swing inwardly toward the wall 44 of the extension 14 which has the tubular discharge member 34 installed therein thereby enabling air to be discharged through the tubular member 34. When the fan 26 is stopped, the damper or flap valve 36 will return to its generally vertical position forming a closure for the opening 40.

The wall 44 also includes a discharge tubular member 46 connected thereto and projecting laterally therefrom with the discharge tubular member 46 being isolated from the supply tubular member 34 by the divider 32. A gravity operated damper 48 in the form of a flap valve is hinged along its top edge at 50 from the wall 44 and will normally close the tubular member 46. Interiorly of the housing 12 is a discharge fan 52 having an inlet 54 in the center as housing communicating with the extension 14 through an opening 56 in wall 42. The fan 52 is also preferably a squirrel cage fan driven by a suitable electric motor and mounted in a suitable manner within the housing 14 and provided with a tangential discharge 58 communicated with and connected peripherally to an opening 60 in the side wall of the housing 12 with a discharge tubular member 62 projecting therefrom and terminating in a downwardly and inwardly inclined free edge 64 to deflect the warm air being discharged in a downward an outward path with a screen 65 being provided in the opening to preclude entry of insects, birds, rodents and the like.

As illustrated in FIG. 1, the supply tubular member 34 may be connected to a duct 66 having a plurality of openings 68 therein spaced upwardly from the bottom edge and spaced longitudinally and of a size to enable equal distribution of cold air throughout the interior area of the walk-in cooler. The duct arrangement is optional and can be a straight duct, or the duct may have several branches depending upon the installational requirements in a walk-in cooler. If desired, the exhaust tubular member may also be connected with a duct arrangement to assure exhaust of warm air from various portions of the walk-in cooler thereby enhancing the cold air circulation throughout the cooler and exhaust of warm air from throughout the cooler.

The air circulation system of this invention provides a natural cooling unit utilizing cold outside ambient air to cool a walk-in cooler thereby enabling the conventional and existing refrigeration system to remain inoperative. This results in reduced consumption of electrical energy thereby reducing the operating cost and reduces maintenance costs since the refrigeration compressor and other components of the refrigeration system will not be operation for various periods of time depending upon the ambient outside temperature during winter. An accustat control generally designated by reference numeral 70 is mounted on the extension 14 to control operation of the air circulation system of the present invention and also to preclude operation of the refrigeration system while the air circulation system is in operation unless humidity conditions within the walk-in cooler are such that the refrigeration system is used to control the humidity within the cooler. The air circulation system of this invention may be adjusted to become operational when the outside temperature is 36° or lower although this may be varied to enable the system to start when outside temperature reaches 40° depending upon the temperature conditions to be maintained within the walk-in cooler. When the outside temperature reaches this condition, and the inside accustat calls for cooling, the air circulation system will commence operation and supply cold outside air into the interior of the walk-in cooler. The outside air can be discharged into the evaporators of the existing refrigeration system and the existing evaporator fans can be used to distribute the cold air into the walk-in or reach-in cooler thus cooling the interior of the cooler by using outside air and keeping the compressor of the refrigeration system from becoming operational thereby saving a substantial percentage of the operating cost of the walk-in cooler. The housing of the air circulation system is mounted through the wall 18 of the cooler 12 with the extension wall 44 being positioned flush with or inwardly of the inner wall surface of the cooler. The housing may be of stainless steel material and, as indicated, include separate supply air and return air chambers with one fan blowing outside air into the cooler and the other fan discharging warm inside air from the cooler. The supply and return dampers open when the fans are operational and close when the fans stop thus closing off the interior of the walk-in cooler. In view of the supply air fan and discharge air fan having the same capacity, there is no increase in the pressure within the walk-in cooler thereby eliminating the necessity of providing elaborate seal devices for the normally provided access door to the cooler. By providing the divider arrangement between the air intake and warm air exhaust and providing the gravity operated damper or flap valves, the intake and exhaust system are completely isolated from each other and the interior of the walk-in cooler is isolated from the exterior when the air circulating system is not in operation. When necessary, the existing refrigeration system can still be used to control the humidity conditions within the walk-in cooler. If the air circulation system is to utilize ducts, a low cost material such as 4" perforated PVC piping may be used with couplings and elbows and caps being used to force all cold air to pass through the perforations and into the desired areas of the walk-in cooler. If the supply side is not ducted, then the exhaust side should be provided with an extended pipe to prevent short circuiting of cold air back through the discharge side or some other type of deflector may be used. In the event condensation occurs when cold outside air meets air in the cooler which may be approximately 38° F. the duct may be provided with a slight degree of inclination provided with a small hole on the elbow or fitting nearest the housing with a container being provided to catch whatever condensation may occur.

Depending upon the location of the walk-in cooler and the normal winter temperatures of such locations, the air circulation system may be utilized for up to 150 to 175 days with corresponding savings in operating costs and maintenance costs which will render the device quite cost effective especially in geographical locations having a relatively large number of days in which the average high temperature does not exceed approximately 40° F.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as now is as follows:

1. An air circulation system for a walk-in or reach-in cooler by which cold outside ambient air can be supplied into the interior of the cooler to maintain the temperature in the cooler within desired parameters without using a refrigeration system normally provided to maintain temperature within the cooler, said air circulation system comprising a housing mounted on the exterior of a wall of a cooler, said housing including a lateral extension extending through an opening in the wall of the cooler, an inlet tubular member extending through said extension, an outlet tubular member extending through said extension, said tubular members communicating said housing with the interior of the cooler, said housing having a peripheral wall including a downwardly facing wall having a cold air inlet opening therein and a vertical wall having a warm air discharge opening therein, a vertical partition in said housing forming an inlet compartment having said air inlet opening therein and a discharge compartment having said discharge opening therein, fan means mounted in said inlet compartment for moving cold air through the air inlet opening and inlet tubular member and fan means mounted in said discharge compartment for moving warm air through said outlet tubular member and said warm air discharge opening thereby supplying cold air to the interior of a cooler and discharging warm air from the interior of the cooler for maintaining predetermined low temperature conditions within the cooler, said inlet tubular member and said outlet tubular member including gravity operated dampers in the form of a flap valve in the interior of each tubular member for automatically closing the tubular members when the fan means are not operating, each of said fan means including a fan with a fan housing and motor with the motors being accustatically controlled to operate only when the walk-in cooler, calls for cooling and ambient outside temperature is below a predetermined low temperature, said fan housing in said inlet compartment including an intake spaced from the peripheral wall and a discharge connected to said wall in communication with said inlet tubular member, said fan housing in said discharge compartment including an intake spaced from the peripheral wall and a discharge connected to said wall and in communication with said discharge opening therein.

2. The air circulation system as defined in claim 1 wherein said cold air inlet opening is provided with an air filter to filter the air supplied to the interior of the cooler.

3. The air circulating system as defining in claim 1 together with an elongated duct means connected with the cold air inlet tubular member for directing an even flow of cold air to various areas of the walk-in cooler.

* * * * *